US005348500A

United States Patent [19]

Lassanske

[11] Patent Number: 5,348,500

[45] Date of Patent: Sep. 20, 1994

[54] MARINE PROPULSION DEVICE WITH SELECTIVELY OPERABLE SECONDARY EXHAUST DISCHARGE

[75] Inventor: George G. Lassanske, Nashotah, Wis.

[73] Assignee: Outboard Marine Corporation, Waukegan, Wis.

[21] Appl. No.: 83,998

[22] Filed: Jun. 28, 1993

[51] Int. Cl.[5] ..... B63H 21/00

[52] U.S. Cl. ..... 440/89; 440/86; 440/900

[58] Field of Search ..... 440/88, 89, 900, 85, 440/86, 87; 60/272; 181/237-239

[56] References Cited

U.S. PATENT DOCUMENTS 3,552,121 1/1971 Kitagawa et al. ..... 60/30
3,943,876 3/1976 Kiekhaefer ..... 440/89
4,586,908 5/1986 Schlichthorst ..... 440/89
4,601,666 7/1986 Wood, Jr. ..... 440/89
4,773,215 9/1988 Winberg et al. ..... 440/89
5,022,877 6/1991 Harbert ..... 440/89
5,106,330 4/1992 Nelson et al. ..... 440/89

*Primary Examiner*—Stephen P. Avila
*Attorney, Agent, or Firm*—Michael, Best & Friedrich

[57] ABSTRACT

The invention provides a marine propulsion device comprising a powerhead including an internal combustion engine having an output shaft and an exhaust port, a propeller shaft adapted to hold a propeller, a selective coupler of the engine output shaft and the propeller shaft, an exhaust passage communicating with the engine exhaust port and comprising a first exhaust outlet and a second exhaust outlet, and a valve that is associated with the selective coupler to open and close the second exhaust outlet.

26 Claims, 1 Drawing Sheet

MARINE PROPULSION DEVICE WITH SELECTIVELY OPERABLE SECONDARY EXHAUST DISCHARGE

BACKGROUND OF THE INVENTION

It is common in the manufacture of marine propulsion devices, such as outboard motors and stern drives, to construct the device with a primary exhaust discharge and a secondary exhaust discharge. The primary exhaust discharge generally directs exhaust into the low pressure area below the water and behind the propeller. This can be accomplished either by directing the exhaust through an outlet on the underside of the anti-ventilation plate or through a hollow propeller hub. Noxious exhaust gases and noise are generally retained in the water.

The secondary exhaust discharge is generally located above the top of the water level when the marine propulsion device is mounted on an associated boat. The secondary exhaust discharge is generally designed to reduce the back pressure of the exhaust gas in the marine propulsion device when the engine is idling or is running at low speed.

Accordingly, the secondary exhaust discharge is commonly referred to as an idle relief passage. Since the idle relief passage bypasses the normal underwater exhaust discharge system, it is designed to minimize the exhaust noise transmitted through it by being designed with a series of baffles. However, in many marine propulsion devices, the idle relief passage allows some noise, along with various noxious exhaust gases, smoke, and in some cases water or steam, to emanate from this outlet under most operating conditions, especially at slow speed.

When a boat is operated for an extended length of time at slow speed a considerable amount of exhaust gas may emanate from the secondary exhaust gas discharge. In certain conditions, such as when the wind is blowing from the stern, these gases can be blown into the boat and cause discomfort to the operator and passengers.

U.S. Pat. No. 3,552,121 shows a marine propulsion device including a vacuum valve in the exhaust for relieving negative pressure created during engine start.

U.S. Pat. No. 4,601,666 discloses an outboard motor with a selectively operable valve in the exhaust passage which diverts all of the exhaust to either the primary under water exhaust discharge port or the secondary above water exhaust discharge port in order to divert exhaust to the secondary exhaust discharge port during slow speed trolling operation in order not to disturb the fish. The diverter is associated with the engine throttle.

U.S. Pat. No. 5,106,330 discloses an outboard motor with a secondary exhaust outlet that automatically shuts off upon high powerhead speed.

SUMMARY OF THE INVENTION

The invention provides a marine propulsion device comprising a powerhead including an internal combustion engine having an output shaft and an exhaust port, a propeller shaft adapted to hold a propeller, means for selectively coupling the engine output shaft and the propeller shaft, an exhaust passage communicating with the engine exhaust port and comprising a first exhaust outlet and a second exhaust outlet, and means associated with the selectively coupling means to open and close the second exhaust outlet.

In one embodiment the propulsion device is adapted to be mounted on a boat floating in a body of water having a top level and the second exhaust outlet is located above the top water level and the first exhaust outlet is located below the top water level.

In one embodiment the marine propulsion device also has an anti-ventilation plate and the first exhaust outlet is located below the anti-ventilation plate.

In one embodiment the propeller has a hollow hub and the first exhaust outlet allows exhaust to pass through the hollow hub.

In one embodiment the marine propulsion device comprises a lower unit adapted to support the powerhead on the top end thereof and rotatably support the propeller shaft near the lower end thereof and containing a vertically extending driveshaft drivingly engaged to the engine output shaft. The lower unit may also contain an exhaust passage and the first and second exhaust outlets.

In one embodiment the means to open and close the second exhaust outlet comprises a sliding door. The selective coupling means comprises a forward-neutral-reverse transmission, and the transmission couples the drive shaft with the propeller shaft. The selective coupling means may also comprise an operator interface including a bell crank, and the bell crank may activate the means to open and close the second exhaust outlet.

In one embodiment the means to open and close the second exhaust outlet closes the second exhaust outlet when the transmission is in the forward position.

The invention also provides a marine propulsion device adapted for driving a boat having a transom comprising a power head having an exhaust port, a lower unit adapted to be mounted on the transom of the boat and supporting the powerhead, the lower unit having a primary exhaust outlet and a secondary exhaust outlet, a propeller shaft rotatably supported in the lower unit and selectively drivingly engageable with the powerhead, the propeller shaft adapted to hold a propeller, means to selectively engage the propeller shaft with the powerhead and means associated with the selective engagement means for opening and closing the secondary exhaust outlet.

In one embodiment the selective engagement means engages the propeller shaft in a forward, a neutral or a reverse direction, and the secondary exhaust outlet is closed when the propeller shaft is engaged in the forward direction.

The invention also provides a marine propulsion device comprising a powerhead having an exhaust port, a propeller shaft selectively connected to the powerhead in driven engagement therewith, means to selectively connect the power head to the propeller shaft, an exhaust passage communicating with the powerhead exhaust port, the exhaust passage comprising a primary exhaust discharge means and a secondary exhaust discharge means, said secondary exhaust discharge means being shut off from communication with the exhaust passage when the powerhead is drivingly connected to the propeller shaft.

A primary feature of the invention is a means to shut off communication of the idle relief port, or secondary exhaust discharge, from the exhaust passage in response to engagement of the transmission, especially engagement of the transmission in a forward direction.

Figure 1:
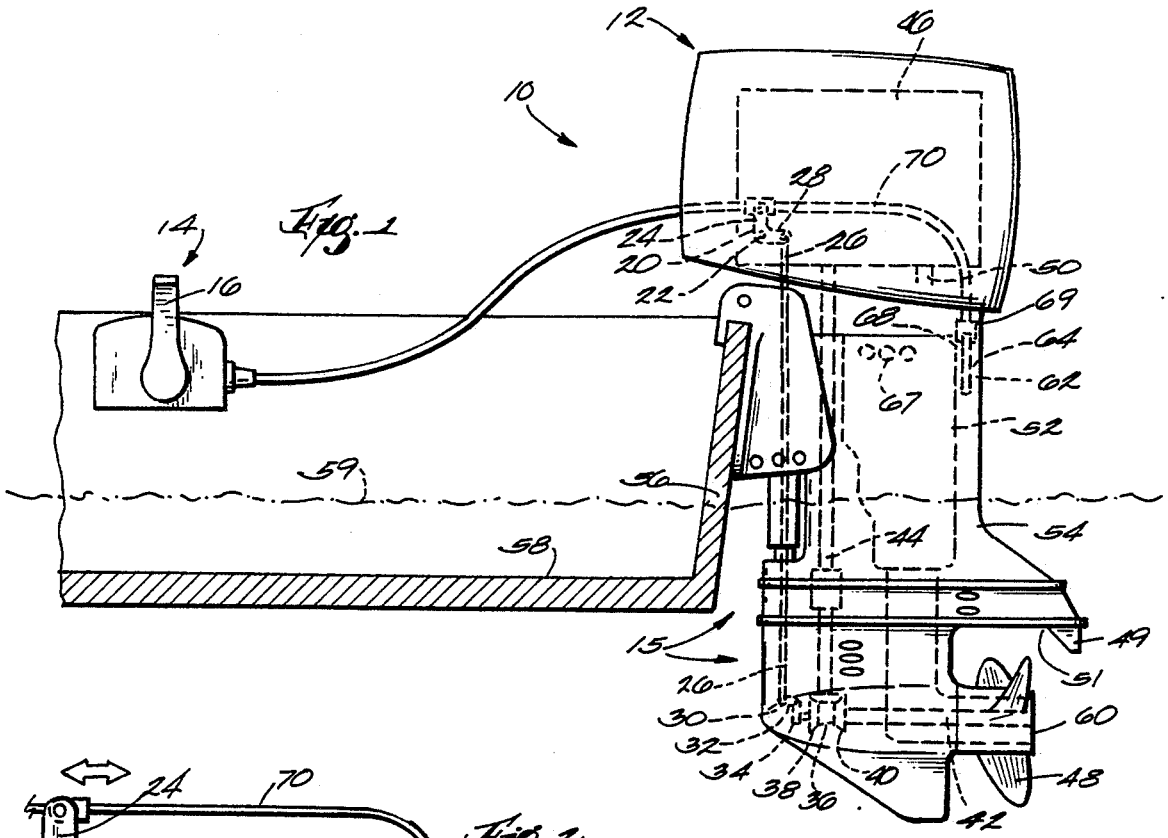
FIG. 1 is a side elevation view of a marine propulsion system including one embodiment of the invention with faint lines showing certain details of the marine propulsion device.

Before explaining at least one of the embodiments of the invention in detail, it is to be understood that the invention is not limited in its application to the details of the construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in the Figures is a marine propulsion system 10 embodying the invention. As seen in FIG. 1, the system comprises a marine propulsion device 12 and an operator control station 14. In the embodiment shown, the marine propulsion device 12 comprises an outboard motor 13. However, the invention will work equally well with a stern drive or other marine propulsion device 12. The operator control station comprises a gear shift lever 16 which is operably connected to the marine propulsion device by connection to a first end of a push pull cable 18. Pivotal movement of the gear shift lever 16 selectively engages and disengages the powerhead 46 from driving engagement with the propeller shaft 42 by operation of a transmission means generally indicated by 15 mounted on the outboard 13.

Not shown, the operator control station 14 also comprises a throttle lever, which may be incorporated into the gear shift lever for operating the throttle of the marine propulsion device 12. Also not shown, the operator control station comprises a steering wheel for controlling steering movement of the marine propulsion device 12.

The transmission means 15 is connected to the second end of push pull cable 18. As is common in the art, the second end of the push pull cable 18 is operatively connected to a first bell crank 20 in the marine propulsion device. The bell crank 20 rotates about a pivot axis 22. The push pull cable is connected to one arm 24 of the bell crank and a vertical transmission shaft 26 is connected to the other arm 28 of the bell crank 20. Accordingly, pivotal movement of the gear shift lever 16 causes rotation of the bell crank 20 and vertical axial movement of transmission shaft 26.

At its lower end, the vertical transmission shaft 26 is also connected to a second bell crank 30 having a pair or arms 32 and 34. In the embodiment shown, vertical motion of the vertical transmission shaft 26 causes rotation of the lower bell crank 30 which slides a dog clutch 36 into and out of engagement with a forward 38 and reverse 40 bevel gear surrounding the propeller shaft 42.

The forward 38 and reverse 40 bevel gears are drivingly engaged to a vertical drive shaft 44 which is driven by a powerhead 46 located near the top end of the marine propulsion device 12. When the dog clutch 36 engages the forward bevel gear 38 the propeller shaft 42 is rotated in a first direction and the associated propeller 48 is rotated in the same first direction to create a forward driving force on the boat. Conversely, when the dog clutch 36 is engaged with the reverse bevel gear the propeller shaft is rotated in a second direction and the associated propeller 48 is driven in the second direction to create a reverse thrust. The transmission means 15 described thus far is common to many existing marine propulsion devices 12 and outboard motors 13.

The outboard 13 also comprises an exhaust system 45 for discharging exhaust gases outside of the outboard 13. The powerhead 46 comprises an exhaust port 50 on its lower face. The exhaust port communicates with an exhaust passage 52 which is located in a lower unit 54 of the marine propulsion device. In the embodiment shown, the lower unit 54 is also adapted to mount the outboard motor 13 onto the transom 56 of the associated boat 58. In addition to containing the exhaust passage 52, the lower unit 54 also supports the powerhead 46 on its top end. The lower unit also rotatably supports the driveshaft 44 and propeller shaft 42.

The exhaust passage 52 also comprises a first or primary exhaust outlet or discharge means 60. In the embodiment shown, the first or primary exhaust outlet or discharge means 60 comprises an exhaust passage through the hollow hub of the propeller 48. When the boat 58 is positioned in a body of water, this first exhaust outlet 60 is located below the top level 59 of the body of water. In other embodiments also known in the art, the first exhaust discharge 60 may be incorporated into the trim tab 49 depending from the anti-ventilation plate 51. In both embodiments, exhaust from the powerhead 46 is deposited in a low pressure area in the water below the top level of the water and immediately behind the propeller when it is turning in the first direction.

The exhaust passage 52 also comprises a second or secondary exhaust discharge outlet or means 62. In the embodiment shown, the secondary exhaust outlet 62 comprises an idle exhaust relief or discharge means near the top of the lower unit and above the top level 59 of the body of water.

Figure 2:
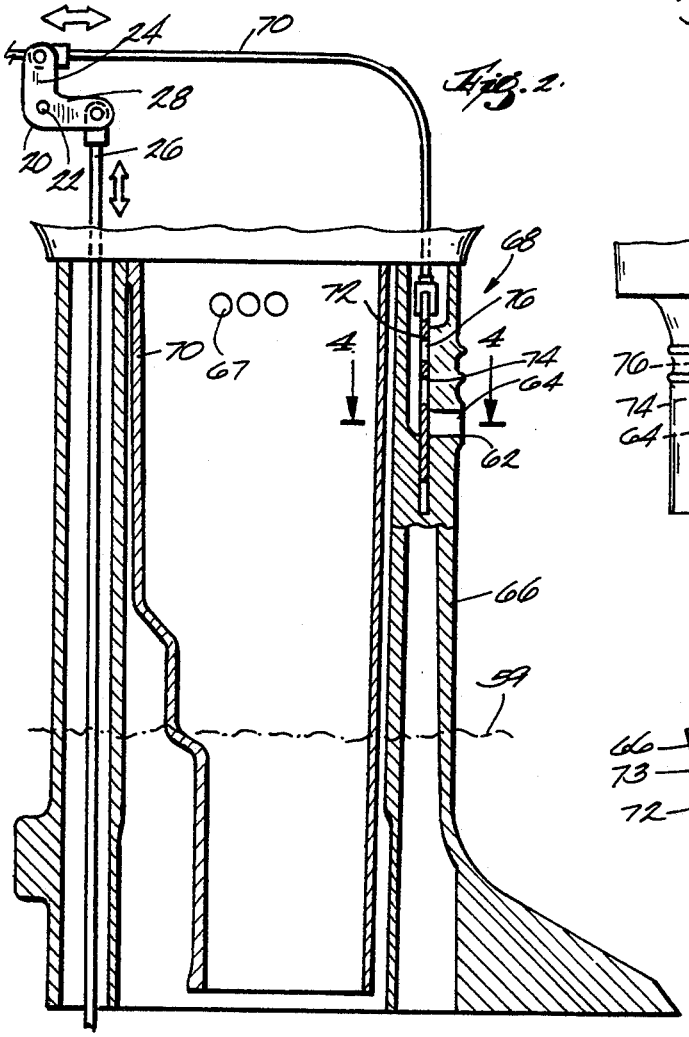
FIG. 2 is a side elevation cutaway view of the marine propulsion device of FIG. 1 showing some details of one embodiment of the invention.
Figure 3:
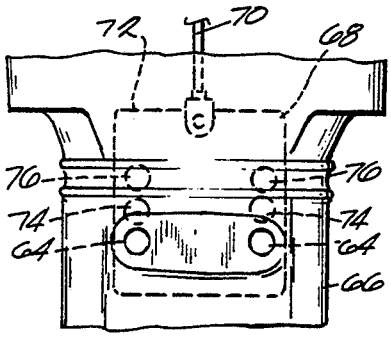
FIG. 3 is a rear elevation view of a portion of the marine propulsion device showing one embodiment of the invention.
Figure 4:
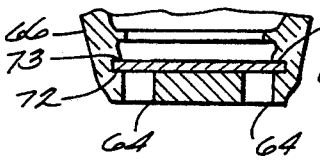
FIG. 4 is a cross section view taken along line 4—4.

As can be seen in FIGS. 2, 3 and 4, the secondary exhaust discharge comprises a pair of horizontally spaced apertures 64 in the outer wall 66 of the lower unit 54. The apertures 64 communicate with the main exhaust passage 52 by means of a series of apertures 67 in the inner exhaust housing 54 and a series of passages having baffles (not shown) in the lower unit, which attempt to muffle exhaust noise. The description of the marine propulsion device 12 up to this point is old in the art.

The marine propulsion device 12 of the invention also comprises a means 68 for selectively opening and closing the second exhaust outlet 62 to allow communication between the second exhaust outlet 62 and the exhaust passage 52. The means 68 for opening and closing the second exhaust outlet 62 comprises a valve 69 that can be open or shut by the operator. As can be seen in FIG. 2, the means 63 for opening and closing the second exhaust outlet is associated with the transmission means 15, or means for selectively engaging and disengaging the propeller shaft 42. In other words, the valve 69 opens and shuts in response to operation of the transmission means 15 by the operator.

More specifically, in a preferred embodiment, a first end of a push pull cable 70 is connected to the bell crank 20 and the second end is connected to a vertically sliding door 72 located near the idle exhaust relief 62. By this construction the door 72 will slide vertically in a slot 73 in response to movement of the bell crank 20. As stated earlier, the bell crank 20 moves in response to operator movement of the gear shift lower 46.

In the embodiment shown, the door 72 has a first lower pair of horizontally spaced apertures 74 and a second upper pair of horizontally spaced apertures 76. Below both sets of apertures 74 and 76 the door is solid. Accordingly, in the condition shown in FIGS. 2 and 3, the transmission means 15 is in the forward condition causing rotation of the propeller shaft in the first direction. Also, the bell crank 20 is pivoted counter clockwise and the door 72 is in the raised position. In this condition, there is no communication between the exhaust passage 52 and the apertures 64 of the secondary exhaust outlet 62 and no exhaust gases are emitted from the secondary exhaust outlet.

Upon operator selection to a neutral condition, or power not being transmitted from the powerhead 46 to the propeller shaft 42, the bell crank 20 rotates clockwise and the door 72 is lowered so that the first pair of apertures 74 become registered with the apertures 64 of the second exhaust outlet. Accordingly, the exhaust gases from the powerhead are allowed to escape through the apertures 74 to the registered apertures 64 and through the second exhaust outlet 62 when the transmission is in the neutral condition. As stated earlier, this allows for exhaust back pressure to be reduced during a neutral idle operating condition since there is no low pressure area behind the propeller.

Also in the embodiment shown, the door 72 has a second set of horizontally disposed apertures 76 above the first set 74. The second set of apertures 76 allow for exhaust to escape the second exhaust outlet 62 when the transmission is in the reverse condition by being in registry with the apertures 64 when the transmission means is so aligned and the bell crank 20 is fully rotated in a clockwise direction. It can be appreciated that a low pressure area is not formed behind the propeller when the outboard is operating in a reverse mode. Accordingly, in this embodiment, the secondary exhaust outlet 62 is open in reverse mode of operation to provide a means for exhaust to easily escape the outboard without raising the exhaust back pressure in the powerhead.

Exhaust can be exited, albeit at a higher pressure through the primary exhaust outlet 60 while the engine is in reverse. Accordingly, in some embodiments, the operator may wish to close the secondary exhaust outlet while in reverse, and in other conditions he may wish to have it open to enhance the runability of the propulsion system. The system can be customized for each desire by including the second set of apertures 76 in the door 72 for those who wish to have the secondary exhaust outlet 62 open in reverse and not providing them in the door 72 for those who wish to have the secondary exhaust outlet 62 closed in reverse.

It can be appreciated that when the exhaust is allowed to be discharged through the secondary exhaust outlet 62 it immediately enters the atmosphere directly behind the boat. If a breeze is blowing from behind the boat, this exhaust can then enter the boat and cause discomfort to the operator and passengers. However, especially in neutral and immediately after start-up, it is important to provide the powerhead of the outboard a low exhaust back pressure in order to let the engine gain a steady state of runability.

In other idle or slow running conditions however, it is desirable to shut off this secondary exhaust outlet. These running conditions include extended slow speed trolling for fish and extended slow speed running through designated no wake zones and harbors. In these conditions, although the engine is idling or at least running at a slow rate, it is in gear and it is desirable to possibly sacrifice some runability of the engine for reduced exhaust fumes in the boat. The invention provides a unique and novel means to limit the time the secondary exhaust outlet is open to only those times it is necessary.

It should be appreciated that although a preferred means 68 to selectively open and close the second exhaust outlet is shown, other valve means may be used and still fit within the scope of the invention. Specifically a rotating or pivoting valve could easily be incorporated. Moreover, even though a preferred direct mechanical actuator or push-pull cable is shown, other actuator means, such as electrical, pneumatic, or hydraulic means may be employed.

I claim:

1. A marine propulsion device comprising a powerhead including an internal combustion engine having an output shaft and an exhaust port, a propeller shaft adapted to hold a propeller, means for selectively coupling said engine output shaft to said propeller shaft, an exhaust passage communicating with said engine exhaust port and comprising a first exhaust outlet and a second exhaust outlet, and means operable in response to operation of said selective coupling means to open and close said second exhaust outlet.

2. The marine propulsion device of claim 1 wherein said device is adapted to be mounted on a boat floating in a body of water having a top level and said second exhaust outlet is located above said top water level.

3. The marine propulsion device of claim 2 wherein said first exhaust outlet is located below said top water level.

4. The marine propulsion device of claim 3 also having an anti-ventilation plate and said first exhaust outlet is below said anti-ventilation plate.

5. The marine propulsion device of claim 3 wherein said propeller has a hollow hub and said first exhaust outlet allows exhaust to pass through said hollow hub.

6. The marine propulsion device of claim 3 also comprising a lower unit adapted to support said powerhead on the top end thereof and rotatably support said propeller shaft near the lower end thereof and containing a vertically extending drive shaft drivingly engaged to said engine output shaft.

7. The marine propulsion device of claim 6 wherein said lower unit also contains said exhaust passage.

8. The marine propulsion device of claim 7 wherein said lower unit also contains said first and second exhaust outlets.

9. The marine propulsion device of claim 8 wherein said means to open and close said second exhaust outlet comprises a sliding door.

10. The marine propulsion device of claim 6 wherein said selective coupling means comprises a forward-neutral-reverse transmission.

11. The marine propulsion device of claim 10 wherein said transmission couples said drive shaft with said propeller shaft.

12. The marine propulsion device of claim 11 wherein said selective coupling means also comprises an operator interface including a bell crank.

13. The marine propulsion device of claim 12 wherein said bell crank also activates said means to open and close said second exhaust outlet.

14. The marine propulsion device of claim 10 wherein said means to open and close said second exhaust outlet closes said second exhaust outlet when said transmission is in the forward position.

15. The marine propulsion device of claim 9 wherein said door also has an aperture therein and said second exhaust outlet also comprises an aperture and said second exhaust outlet is open when said apertures are in registry.

16. A marine propulsion device adapted for driving a boat having a transom comprising a powerhead having an exhaust port, a lower unit adapted to be mounted on the transom of the boat and supporting said powerhead, said lower unit having a primary exhaust outlet and a secondary exhaust outlet, a propeller shaft rotatably supported in said lower unit and adapted to hold a propeller, means for selectively engaging said propeller shaft with said powerhead, and means operable in response to operation of said selective engagement means for opening and closing said secondary exhaust outlet.

17. The marine propulsion device of claim 16 wherein said selective engagement means engages said propeller shaft in a forward, a neutral or a reverse direction.

18. The marine propulsion device of claim 17 wherein said secondary exhaust outlet is closed when said propeller shaft is engaged in the forward direction.

19. The marine propulsion device of claim 18 wherein said propeller includes a hollow hub and said primary exhaust outlet is through said hollow hub.

20. The marine propulsion device of claim 19 wherein said means for opening and closing said secondary exhaust outlet comprises a door sliding in a groove from an open to a closed position.

21. The marine propulsion device of claim 20 wherein said door also has an aperture therein and said aperture is in registry with said secondary exhaust outlet in the open position.

22. A marine propulsion device comprising a powerhead having an exhaust port, a propeller shaft, means for selectively connecting and disconnecting said powerhead to said propeller shaft, an exhaust passage communicating with said powerhead exhaust port, said exhaust passage comprising a primary exhaust discharge means and a secondary exhaust discharge means, said secondary exhaust discharge means including a member movable between an open position and a closed position, and means connected between said member and said selective connecting and disconnecting means and operable in response to operation of said selective connection and disconnection means for closing said exhaust passage when said powerhead is drivingly connected to said propeller shaft.

23. The marine propulsion device of claim 22 wherein said means to selectively connect said powerhead to said propeller shaft includes a forward-neutral-reverse transmission.

24. The marine propulsion device of claim 23 wherein said transmission includes a pair of bevel gears and a sliding dog clutch.

25. The marine propulsion device of claim 24 also having a lower unit adapted to be mounted on a boat floating in a body of water having a top level and said primary exhaust discharge means is located in said lower unit and below said top water level.

26. The marine propulsion device of claim 25 wherein said secondary exhaust discharge means is located above said top water level.

* * * * *